US009244391B2

(12) United States Patent
Ando et al.

(10) Patent No.: US 9,244,391 B2
(45) Date of Patent: Jan. 26, 2016

(54) IMAGE FORMING APPARATUS

(71) Applicant: CANON KABUSHIKI KAISHA, Tokyo (JP)

(72) Inventors: Akifusa Ando, Fujisawa (JP); Kazuyuki Iwamoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/660,810

(22) Filed: Mar. 17, 2015

(65) Prior Publication Data

US 2015/0268592 A1 Sep. 24, 2015

(30) Foreign Application Priority Data

Mar. 20, 2014 (JP) ..... 2014-057969

(51) Int. Cl.
*G03G 15/16* (2006.01)

(52) U.S. Cl.
CPC ..... *G03G 15/1605* (2013.01)

(58) Field of Classification Search
CPC ..... G03G 15/161; G03G 3315/0177; G03G 15/1605; G03G 15/5008; G03G 15/1675
See application file for complete search history.

(56) References Cited

U.S. PATENT DOCUMENTS 6,370,354 B1 * 4/2002 Chapman ..... G03G 15/6564 399/394
6,418,294 B2 * 7/2002 Morikami ..... G03G 15/0131 399/298
6,442,356 B2 * 8/2002 Omata ..... G03G 15/0131 399/299
6,519,438 B2 * 2/2003 Munemori ..... G03G 15/0131 399/298
8,909,080 B2 * 12/2014 Mochizuki ..... G03G 15/0189 399/44
9,091,965 B2 * 7/2015 Nakaegawa ..... G03G 15/0189
2005/0207798 A1 * 9/2005 Okabe ..... G03G 15/0194 399/299
2009/0097888 A1 * 4/2009 Hirai ..... G03G 15/1605 399/308
2012/0057892 A1 * 3/2012 Endoh ..... G03G 15/0189 399/66

FOREIGN PATENT DOCUMENTS

JP 2000-047497 A 2/2000
JP 2001-296720 A 10/2001
JP 2005-148198 A 6/2005

* cited by examiner

*Primary Examiner* — Francis Gray
(74) *Attorney, Agent, or Firm* — Canon U.S.A., Inc. IP Division

(57) ABSTRACT

First to N-th image forming units are sequentially arranged from the upstream to the downstream along the movement direction of an intermediate transfer belt. When L is defined as a distance between contact points of every two adjacent ones of the first to N-th image bearing members with the intermediate transfer member, when V is defined as a moving speed of the intermediate transfer belt and, when a timing at which transfer bias applying unit for the n-th image forming unit is turned off using a timing at which the transfer bias applying unit for the first image forming unit is turned off as reference is defined as $(L/V)\times(n-1)+\alpha_n$, $\alpha_n$ for every integer n between 2 and N is set so that an absolute value of $\alpha_n$ is less than L/V and at least one pair of $\alpha_n$ among the plurality of $\alpha_n$ has different values.

8 Claims, 7 Drawing Sheets

IMAGE FORMING APPARATUS

BACKGROUND OF THE INVENTION

1. Field of the Invention

The present invention relates to an image forming apparatus, such as a printer, a facsimile, or a copying machine, using an electrophotographic process or an electrostatic recording process.

2. Description of the Related Art

A variety of image forming apparatuses using an electrophotographic process or an electrostatic recording process as an image forming process have been developed. An example of such a variety of image forming apparatuses is an intermediate transfer tandem type image forming apparatus having a plurality of process cartridges arranged in a line along a rotational direction of an intermediate transfer belt rotatably tensioned to form a color image via an intermediate transfer belt.

In the image forming apparatus, each of the process cartridges includes a photosensitive drum. A primary transfer roller is disposed so as to face each of the photosensitive drums with the intermediate transfer belt therebetween. The primary transfer rollers correspond to a yellow (Y) color, a magenta (M) color, a cyan (C) color, and a black (Bk) color. The timings at which transfer operations performed by the primary transfer rollers Y, M, C, and K (corresponding to the colors) are shifted sequentially from each other. The timings of switching ON-OFF of transfer bias applied to the primary transfer rollers are shifted sequentially in synchronization with the timings at which the transfer operations are performed.

The ON-OFF switching of the transfer bias applied to the primary transfer rollers causes a variation of the moving speed of the intermediate transfer belt, causes a variation of the position in the sub-scanning direction and, thus, causes out of color registration. That is, if transition from the transfer-on state to the transfer-off state occurs, transition from a state in which the intermediate transfer belt is electrostatically attracted to the photosensitive drum to a state in which the intermediate transfer belt is not electrostatically attracted to the photosensitive drum occurs. Accordingly, a variation of the speed of the intermediate transfer belt occurs due to a change in the attraction state between the intermediate transfer belt and the photosensitive drum. Thus, an "out of color registration" problem arises. In addition, in the image forming apparatus, when the downstream primary transfer roller performs a transfer operation, the timings at which the transfer bias is turned off for the upstream primary transfer roller is the same for all primary transfer units. Thus, a variation of the position occurs at the same position of a recording medium. As a result, a line-like image artifact that extends on the recording medium (a sheet) in the main scanning direction may become prominent. That is, a line-like image may disadvantageously become darker.

Japanese Patent Laid-Open No. 2005-148198 describes an image forming apparatus to address such an issue. In the image forming apparatus, when an overlapped image formed on the intermediate transfer belt is secondary-transferred onto a recording medium, the transfer bias is continuously applied to all the primary transfer rollers for a period of time from the time the transfer operation performed by the Y primary transfer roller starts until the transfer operation performed by the Bk primary transfer roller is completed. By avoiding ON-OFF switching of application of transfer bias to any one of the primary transfer rollers in this manner, a variation of the speed of the intermediate transfer belt caused by ON-OFF switching is prevented and, thus, degradation of the image quality, such as out of color registration, can be reduced.

SUMMARY OF THE INVENTION

According to an aspect of the present invention, an image forming apparatus includes N image bearing members each allowing a toner image to be formed thereon, where N is 3 or greater, N image forming units each having one of the image bearing members, where the image bearing members are disposed at equal intervals, an intermediate transfer member configured to move so as to allow toner images to be sequentially transferred thereonto at transfer positions at which the intermediate transfer member faces the image bearing members, where the first to N-th image forming units being sequentially arranged from the upstream to the downstream along the movement direction of the intermediate transfer member, N transfer members each configured to transfer a toner image from one of the image bearing members onto the intermediate transfer member at the transfer position located between the intermediate transfer member and the image bearing member, N transfer power sources each configured to apply a transfer bias to one of the N transfer members, and a setting unit configured to set, when L is defined as a distance between contact points of every two adjacent ones of the first to N-th image bearing members with the intermediate transfer member, when V is defined as a moving speed of the intermediate transfer belt, and when a timing at which the transfer power source for the n-th image forming unit is turned off using a timing at which the transfer power source for the first image forming unit is turned off as a reference is defined as $$(L/V)\times(n-1)+\alpha_n,$$

$\alpha_n$ for every integer n greater than or equal to 2 and less than or equal to N so that an absolute value of $\alpha_n$ is less than L/V and at least one pair of $\alpha_n$ among the plurality of $\alpha_n$ has different values.

Further features of the present invention will become apparent from the following description of exemplary embodiments with reference to the attached drawings.

DESCRIPTION OF THE EMBODIMENTS

Figure 1:
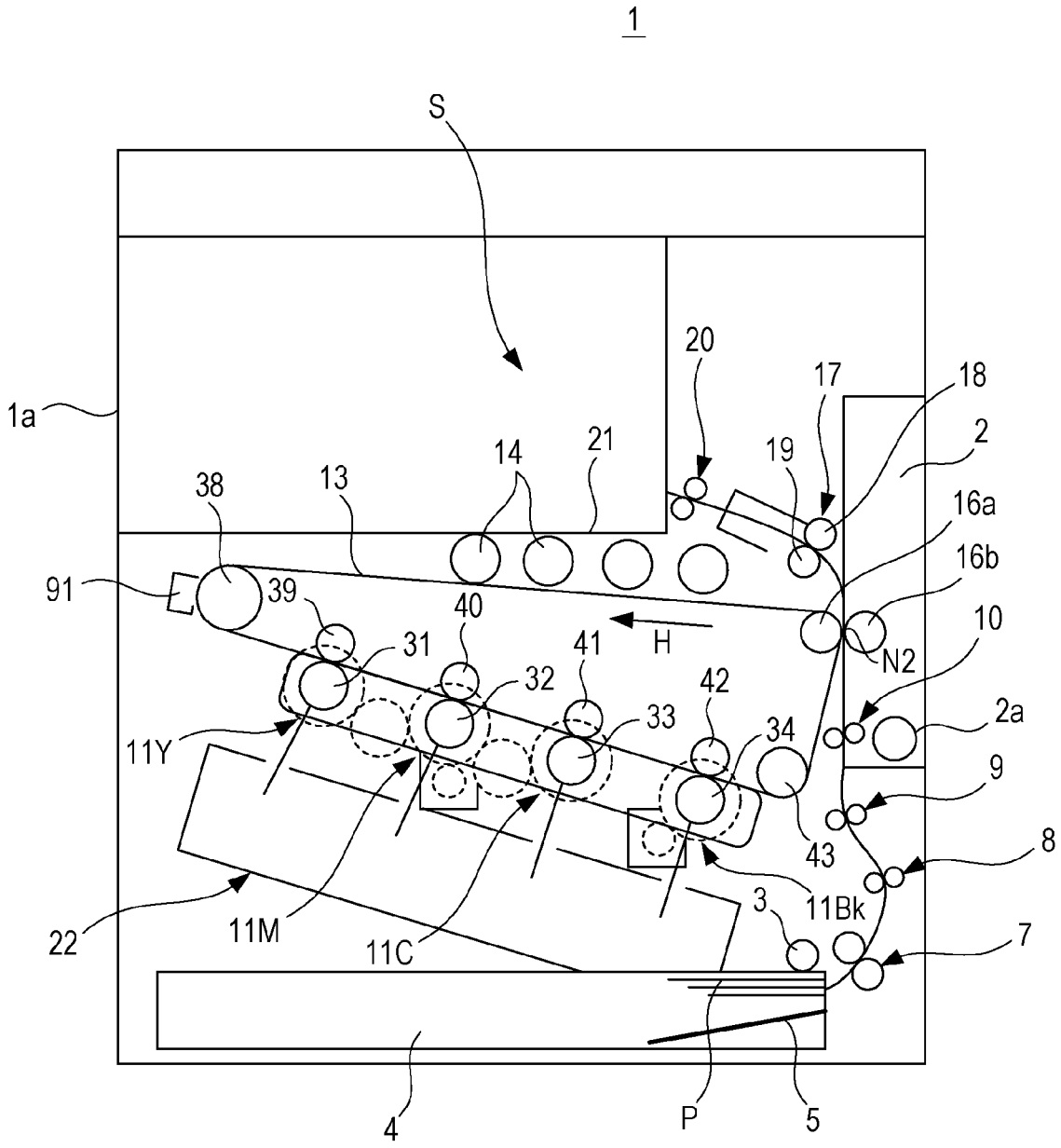
FIG. 1 is a cross-sectional view schematically illustrating an image forming apparatus according to an exemplary embodiment of the present invention.
Figure 2:
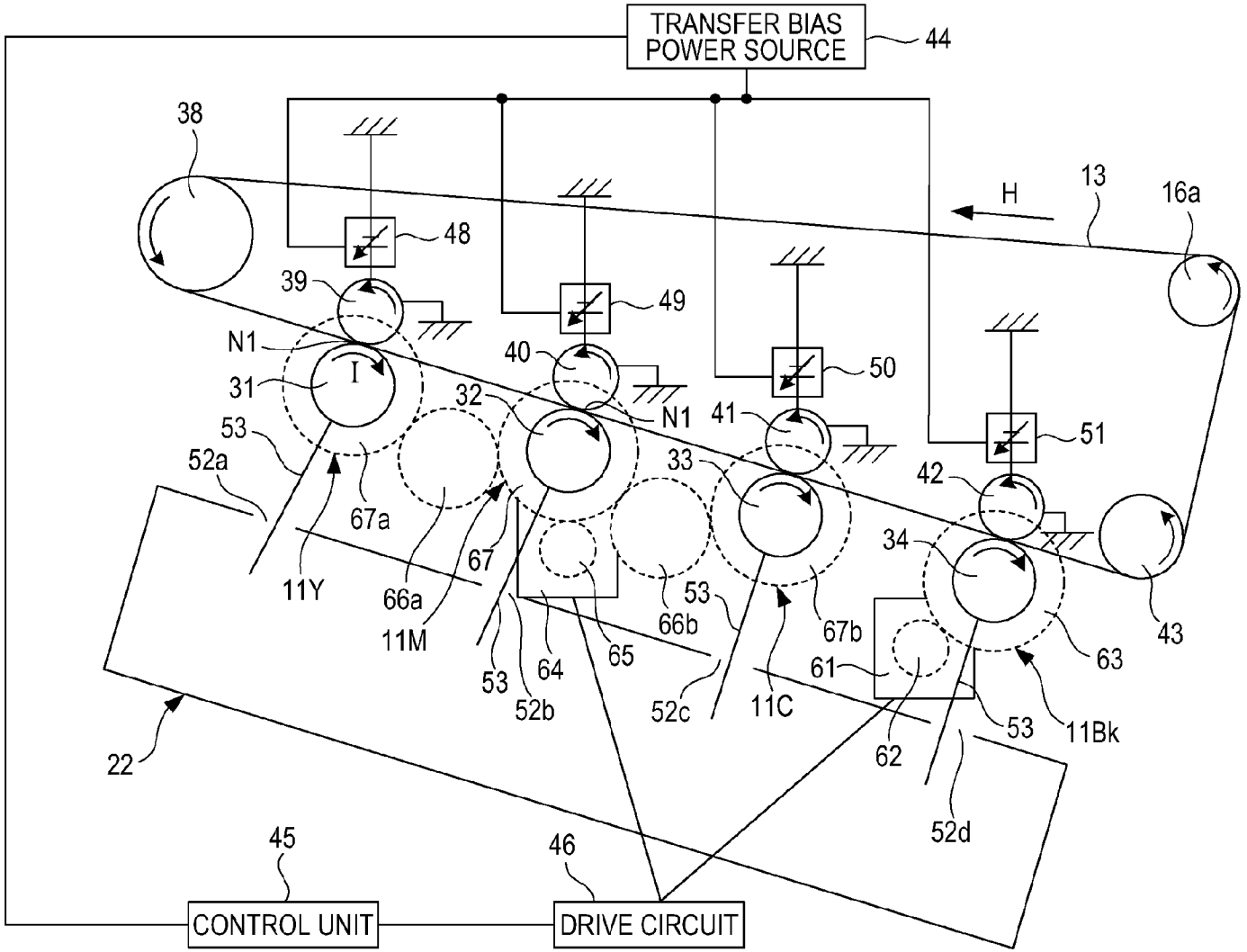
FIG. 2 is a block diagram of main drive units and the structure for controlling the main drive units according to the present exemplary embodiment.

Exemplary embodiments of the present invention are described below with reference to the accompanying drawings. FIG. 1 is a cross-sectional view schematically illustrating an image forming apparatus 1 (e.g., a tandem type color printer) according to an exemplary embodiment. FIG. 2 is a block diagram of main drive units and the structure for controlling the main drive units according to the present exemplary embodiment.

As illustrated in FIG. 1, the image forming apparatus 1 includes an apparatus main body 1*a*. The apparatus main body 1*a* includes a first image formation unit (11Y) to an N-th image formation unit (11Bk). The image forming units 11Y to 11Bk are sequentially arranged from the upstream to the downstream along the movement direction of an intermediate transfer belt 13 serving as an intermediate transfer member (a rotational direction indicated by an arrow H).

The image forming unit 11Y forms a yellow (Y) color image, the image forming unit 11M forms a magenta (M) color image, the image forming unit 11C forms a cyan (C) color image, and the image forming unit 11Bk forms a black (Bk) color image.

As illustrated in FIG. 2, the image forming units 11Y, 11M, 11C, and 11Bk include photosensitive drums 31, 32, 33, and 34 serving as image bearing members, respectively. The photosensitive drums 31, 32, 33, and 34 are disposed at equal intervals so that the axis directions thereof are parallel to one another. In the vicinity of the rotatable photosensitive drums 31, 32, 33, and 34 on which a toner image is formed, charging devices (not illustrated), developing units (not illustrated), primary transfer rollers 39, 40, 41, and 42 serving as transfer members, and drum cleaners (not illustrated) are disposed, respectively. The primary transfer rollers 39 to 42 are transfer rollers that are rotatable while being in contact with the intermediate transfer belt 13.

The plurality of image forming units (four units, that is, the image forming units 11Y, 11M, 11C, and 11Bk, in the present exemplary embodiment) include the photosensitive drums 31, 32, 33, and 34, respectively. The photosensitive drums are disposed at equal intervals ("L" in FIG. 4). The primary transfer rollers 39, 40, 41, and 42 transfer toner images from the photosensitive drums 31, 32, 33, and 34 onto the intermediate transfer belt 13 at a transfer position (a contact point A in FIG. 4) located between the intermediate transfer belt 13 and each of the photosensitive drums 31, 32, 33, and 34, respectively.

The intermediate transfer belt 13 is formed as a continuous belt that revolves and conveys the transferred toner images. The intermediate transfer belt 13 revolves (moves) so that the toner images formed on the photosensitive drums (the image bearing members) are sequentially transferred thereonto at the transfer positions (the contact points A in FIG. 4) at which the photosensitive drums 31 to 34 face the intermediate transfer belt 13.

Beneath the photosensitive drum 31 of the image forming unit 11Y, a slit 52*a* of a scanning optical device (an exposure unit) 22 is located. Beneath the photosensitive drum 32 of the image forming unit 11M, a slit 52*b* of the exposure unit 22 is located. Beneath the photosensitive drum 33 of the image forming unit 11C, a slit 52*c* of the exposure unit 22 is located. Beneath the photosensitive drum 34 of the image forming unit 11Bk, a slit 52*d* of the exposure unit 22 is located. The exposure unit 22 emits laser beams 53 corresponding to the Y, M, C, and Bk colors from the slits 52*a*, 52*b*, 52*c*, and 52*d* to surfaces of the photosensitive drums 31, 32, 33, and 34, respectively. Thus, the exposure unit 22 forms an electrostatic latent image on each of the surfaces of the drums 31 to 34.

Each of the charging devices (not illustrated) uniformly charges one of the surfaces of the photosensitive drums 31, 32, 33, and 34 using a charge bias applied from a charging bias power source (not illustrated) so that the surfaces have a predetermined potential of a negative polarity. The developing units (not illustrated) contain Y color toner, M color toner, C color toner, and Bk color toner. The toner can be resupplied from each of toner bottles 14 (see FIG. 1) as needed.

A drive transmitting mechanism of each of the photosensitive drums 31, 32, and 33 is configured so that the photosensitive drums 31, 32, and 33 are rotationally driven by a color motor gear 65 driven by a shared color motor 64 via a color drive gear 67, idler gears 66*a* and 66*b*, and color drive gears 67*a* and 67*b*. A drive transmitting mechanism of the photosensitive drum 34 is configured so that when black monochrome printing is performed, the photosensitive drum 34 is rotationally driven by a Bk motor gear 62 rotated by a dedicated Bk motor 61 via a Bk drive gear 63. The color motor 64 and the Bk motor 61 that drive the photosensitive drums 31 to 34 are controlled by a drive circuit 46 of a control unit 45 corresponding to a control unit of the present invention.

Each of the developing units (not illustrated) includes a developing roller (not illustrated). The developing roller is in contact with a corresponding one of the photosensitive drums 31 to 34 and starts rotating in a direction opposite to the rotational direction of the photosensitive drum at a time when a development bias is applied. In this manner, development starts. The developing units deposit Y color toner, M color toner, C color toner, and Bk color toner onto the corresponding photosensitive drums 31, 32, 33, and 34 to develop the electrostatic latent images into toner images.

Each of the photosensitive drums 31 to 34 has a photoconductive layer on a drum base substance made of aluminum and serving as an OPC photoconductor of a negative polarity. The photosensitive drum is rotatingly driven by the driving unit (not illustrated) in a direction of an arrow I illustrated in FIG. 2 at a predetermined process speed.

The primary transfer rollers 39, 40, 41, and 42 are in contact with the photosensitive drums 31, 32, 33, and 34, respectively, via the intermediate transfer belt 13 in primary transfer nip portions N1 (contact positions). The primary transfer rollers 39, 40, 41, and 42 have the transfer bias applied thereto from a transfer bias power source 44 via switching units 48, 49, 50, and 51, respectively, under the control of a bias control portion 71 of the control unit 45.

Drum cleaner units (not illustrated) are made from, for example, cleaning blades. The drum cleaner units remove residual toner remaining on the photoconductors of the photosensitive drums 31, 32, 33, and 34 at the time of primary transfer.

As illustrated in FIG. 1, the intermediate transfer belt 13 formed as a continuous belt is rotatably (movably) entrained by the drive roller 16*a* serving as the secondary transfer inner roller, a tension roller 38, and a stretching roller 43 in a direction of an arrow H (a counterclockwise direction). Note that the intermediate transfer belt 13 is formed of a dielectric resin, such as a polycarbonate or polyethylene terephthalate resin film or a polyvinylidene fluoride resin film.

The drive roller 16*a* serving as the secondary transfer inner roller is disposed so as to face a secondary transfer outer roller 16*b*. The drive roller 16*a* is in contact with the secondary transfer outer roller 16*b* via the intermediate transfer belt 13 to form a secondary transfer unit (a secondary transfer nip portion N2). The secondary transfer unit (N2) secondary-transfers, to a recording medium P conveyed from the paper cassette 4, the toner image that has been primary-transferred onto the intermediate transfer belt 13. In addition, in the vicinity of the tension roller 38 on the outer side of the intermediate transfer belt 13, a belt cleaning unit 91 is disposed. The belt cleaning unit 91 removes transfer residual toner remaining on the surface of the intermediate transfer belt 13 and collects the toner.

The paper cassette 4 is disposed in the lower section of the apparatus main body 1*a*. The paper cassette 4 allows the recording media P to be stacked on an inner plate 5 thereof and, thus, contains the recording media P. The recording media P contained in the paper cassette 4 are fed one by one by a feed roller 3 disposed at a position downstream thereof in the media feed direction. The recording medium P is conveyed to a registration pair 10 by conveying roller pairs 7, 8, and 9 disposed downstream of the feed roller 3 and is tentatively stopped at the position of the registration pair 10. Thereafter, conveyance of the recording medium P is restarted at appropriate timing so that the toner image is transferred onto the recording medium P at a predetermined position in the secondary transfer unit (N2).

The recording medium P having the toner image secondary-transferred in the secondary transfer unit (N2) is heated and pressed in the fixing unit 17 disposed downstream of the secondary transfer unit. Thus, the toner image is fixed to the recording medium P. Thereafter, the recording medium P is output onto a sheet discharge tray 21 via a sheet-output-roller pair 20. The fixing unit 17 is formed by a fixing roller 19 and a pressure roller 18 disposed so as to face each other. The pressure roller 18 is in pressure contact with the fixing roller 19. The apparatus main body 1*a* has a door unit 2 on one side. The apparatus main body 1*a* supports the door unit 2 in a rotatable manner about a rotating shaft 2*a*. Thus, the secondary transfer outer roller 16*b* can be separated from the drive roller 16*a*.

The control system according to the present exemplary embodiment is described next with reference to FIG. 3. Note that FIG. 3 is a block diagram of the control system according to the present exemplary embodiment.

Figure 3:
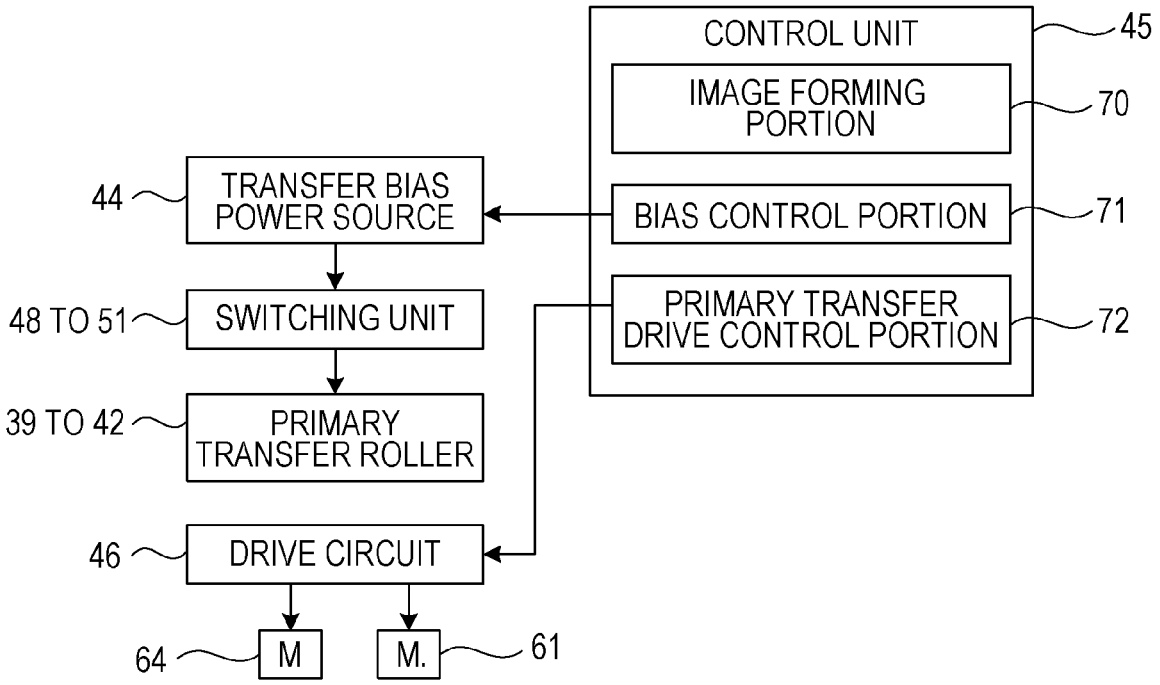
FIG. 3 is a block diagram of a control system according to the exemplary embodiment.

That is, as illustrated in FIG. 3, the control unit 45 corresponding to a control unit of the invention is formed from a microcomputer including a read only memory (ROM), a random access memory (RAM), and a central processing unit (CPU) (none are illustrated). The control unit 45 includes an image forming portion 70, the bias control portion 71, and a primary transfer drive control portion 72.

The image forming portion 70 outputs, to each of the units, commands based on information input from an operation unit provided in the apparatus main body 1*a*. Thus, an image forming process (image generation) is performed using the image forming units 11Y, 11M, 11C, and 11Bk.

The bias control portion 71 applies the transfer bias to the primary transfer rollers 39 to 42. That is, the bias control portion 71 performs on/off control on the transfer bias power source 44 and applies a transfer bias voltage to the primary transfer rollers 39, 40, 41, and 42 using the switching units 48, 49, 50, and 51, respectively. When the control unit 45 performs on/off control of application of the transfer bias, the bias control portion 71 performs on/off control of application of the transfer bias using the transfer bias power source 44 in synchronization with the transfer operations performed by the primary transfer rollers 39 to 42 for the four colors. Note that N transfer bias applying units are formed by the transfer bias power source 44, the switching units 48 to 51, and the bias control portion 71.

The primary transfer drive control portion 72 controls the color motor 64 and the Bk motor 61 via the drive circuit 46.

Figure 4:
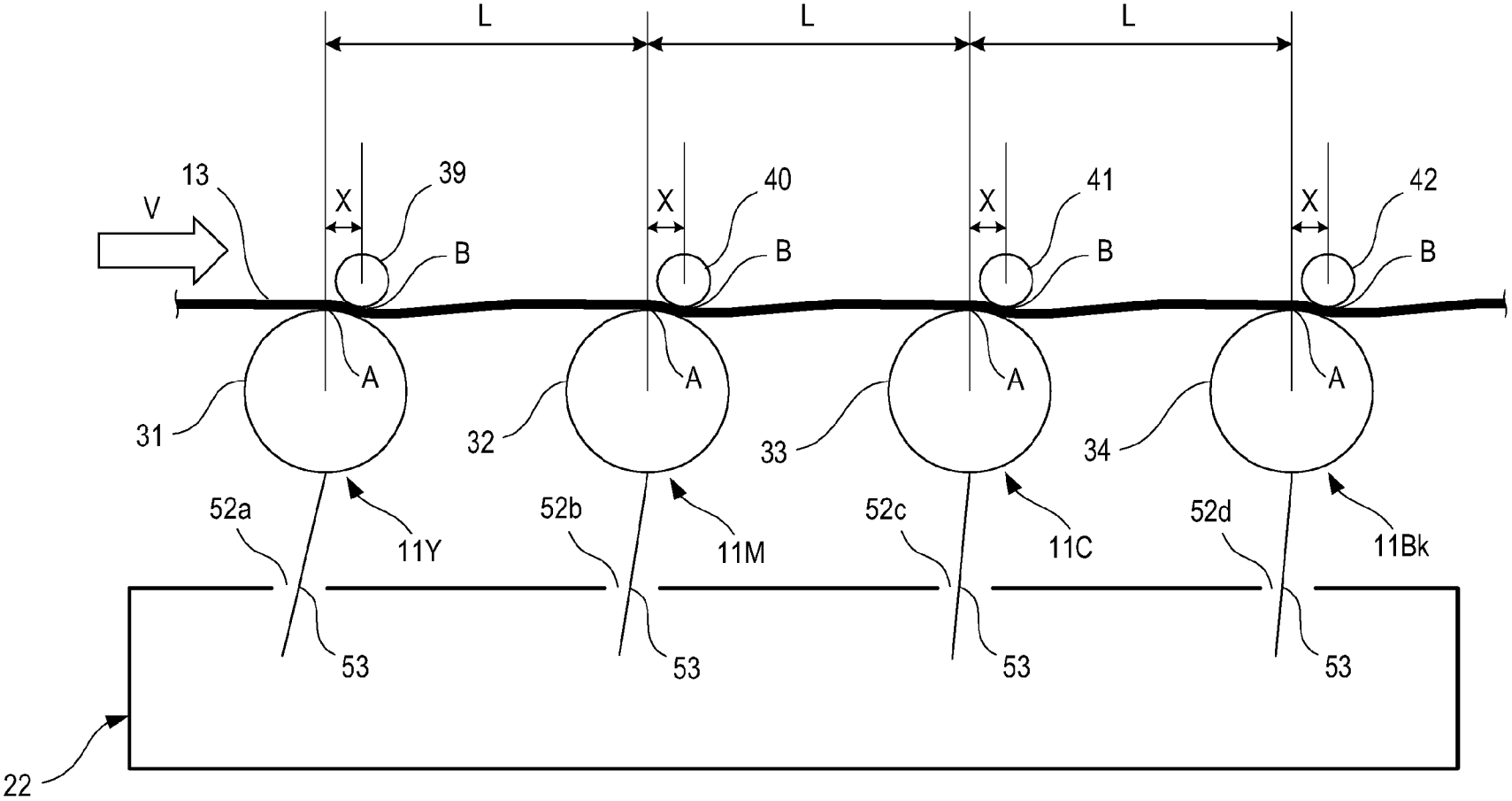
FIG. 4 illustrates the parameters of conditional expressions for control according to the exemplary embodiment.

The parameters of conditional expressions for control and an example of the operation control are described below with reference to FIGS. 4 and 5. FIG. 4 illustrates the parameters of conditional expressions for control, and FIG. 5 is a timing diagram illustrating an example of the operation control.

Figure 5:
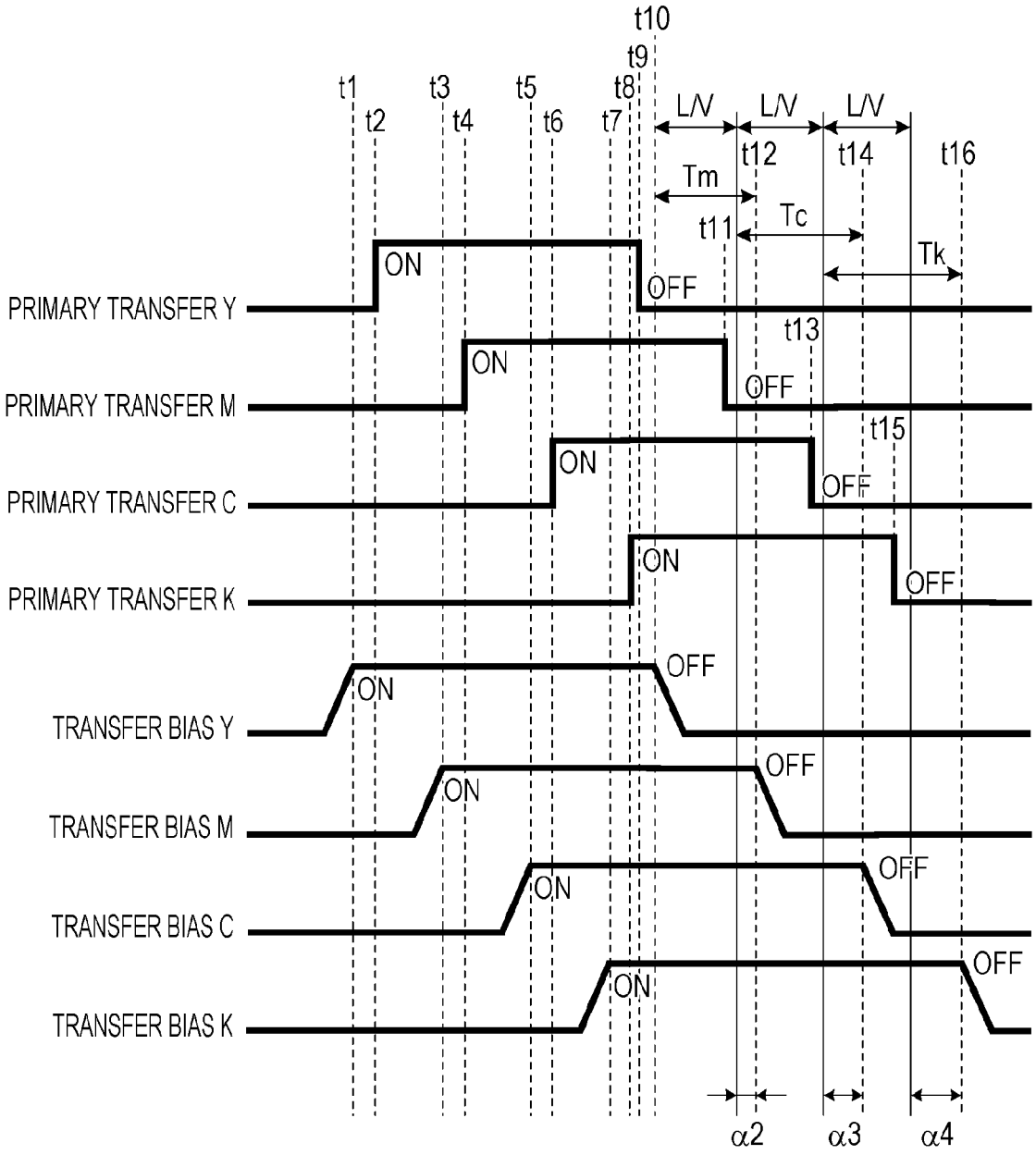
FIG. 5 is a timing diagram illustrating an example of operation control according to the exemplary embodiment.

As illustrated in FIGS. 4 and 5, the control unit 45 performs the following control. That is, let L (mm) be the distance between every two adjacent ones of the photosensitive drums 31 to 34 (the distance between the image bearing members, the drum center-to-drum center distance), and let V (mm/s) be the moving speed of the intermediate transfer belt 13 (a belt speed). In addition, let X (mm) be the offset distance between a contact point between the intermediate transfer belt 13 and each of the photosensitive drums 31, 32, 33, and 34 (the point A illustrated in FIG. 4) and a contact point between the intermediate transfer belt 13 and one of the primary transfer rollers 39, 40, 41, and 42 corresponding to the photosensitive drum (a point B illustrated in FIG. 4). That is, "X" (mm) is defined as an offset distance between a vertical line that passes through the center of each of the photosensitive drums 31, 32, 33, and 34 and a vertical line that passes through the center of one of the primary transfer rollers 39, 40, 41, and 42 corresponding to the photosensitive drum.

Furthermore, an image formation unit that completes a transfer operation performed by one of the primary transfer rollers 39 to 42 (e.g., the image forming unit 11Y) at the first earliest time is defined as a "first image formation unit". An image formation unit that completes a transfer operation performed by one of the primary transfer rollers 39 to 42 (e.g., the image forming unit 11Bk) at the n-th earliest time (e.g., the fourth earliest time) is defined as an "n-th image formation unit". Let $\alpha_n$ be a deviation of transfer off timing from a transfer off timing for the transfer position (the contact point A illustrated in FIG. 4) in the n-th image formation unit, and let $T_n(n\geq 2)$ be a difference between the transfer off timing in the n-th image formation unit and the transfer off timing in the (n−1)th image formation unit (e.g., the image forming unit 11C). Then, the control unit 45 performs image control so as to satisfy the following expressions:

$$T_n=L/V+\alpha_n \tag{1}$$

$$X/V<\alpha_n<L/V \tag{2}$$

$$T_n\neq T_k(n\neq k,k\geq 2) \tag{3}$$

In addition, the control unit 45 performs image control so that the difference between $T_n$ and another $T_n$ is greater than or equal to X/V. The control unit 45 controls the transfer off timing of the transfer bias of each of the above-described transfer bias applying units (the transfer bias power source 44, the switching units 48 to 51, and the bias control portion 71) so as to satisfy such conditions.

Thus, the control unit 45 performs control so as to satisfy the following relational expressions:

$X/V<\alpha_2<L/V$, $X/V<\alpha_3<L/V$, and $X/V<\alpha_4<L/V$.

According to the present exemplary embodiment, the reason why "X/V" is used in the transfer off timing control is as follows. That is, "X/V" represents a period of time during which a transfer process (the primary transfer process) is performed in the primary transfer nip portion N1 of the primary transfer unit. The operation in the primary transfer nip portion N1 is a complex mix of the belt speeds in the main scanning direction and the sub scanning direction. Accordingly, it is not desirable that during the transfer process in the primary transfer nip portion N1, another image formation unit (another station) electrically turns on and off a transfer bias. Thus, the control unit 45 is configured so as not to turn off the transfer bias for an interval of "X/V".

As illustrated in FIG. 4, the contact point A between the intermediate transfer belt 13 and each of the photosensitive drums 31, 32, 33, and 34 is not the same as the contact point B between the intermediate transfer belt 13 and the corresponding one of the primary transfer rollers 39, 40, 41, and 42. There is a certain distance X between the contact point A and the contact point B (X represents the offset distance of the primary transfer roller). The four photosensitive drums 31 to 34 are disposed at predetermined equal intervals so that the axis directions thereof are parallel to one another, as described above.

In addition, the off times of the transfer bias for the four colors are defined in the order in which the primary transfer is completed, as follows:

$$T1=Ty, T2=Tm, T3=Tc, \text{ and } T4=Tk.$$

Then, the control is performed so as to satisfy the conditions described below. Note that Ty represents a time interval from the time a Y station (the image forming unit 11Y) completes primary transfer to the time an M station (the image forming unit 11M) completes primary transfer. To increase the useful life of the photosensitive drums 31 and 32, it is desirable that the transfer bias is turned off immediately after the primary transfer in the Y station.

That is, the control unit 45 performs control so that the following relational expressions are satisfied:

$$Tm=L/V+\alpha_2 \quad (4)$$

$$Tc=L/V+\alpha_3 \quad (5)$$

$$Tk=L/V+\alpha_4 \quad (6)$$

If, like the present exemplary embodiment, four photosensitive drums are provided to form a four-color image, the control unit 45 performs the following control. That is, an image formation unit that completes the second earliest transfer operation performed by the primary transfer roller is defined as a second image formation unit (11M). An image formation unit that completes the third earliest transfer operation is defined as a third image formation unit (11C). An image formation unit that completes the fourth earliest transfer operation is defined as a fourth image formation unit (11Bk). Then, the control unit 45 performs control so that the following relational expressions are satisfied:

$$X/V<|T2-T3| \quad (7)$$

$$X/V<|T2-T4| \quad (8)$$

$$X/V<|T3-T4|(T2\neq T3\neq T4) \quad (9)$$

Accordingly, as can be seen from the timing diagram illustrated in FIG. 5, applied-bias-on operations in the primary transfer operations performed by the primary transfer rollers 39 to 42 on the basis of the above-described conditions are temporally shifted sequentially from each other. Note that for each of the colors, primary transfer is performed after the applied bias is turned on. Similarly, applied-bias off operations in the primary transfer operations are temporally shifted sequentially from each other. For each of the colors, primary transfer bias is turned off at a time later than the primary transfer completion time.

According to the present exemplary embodiment, the primary transfer bias off timings in the primary transfer operations for all the colors (i.e., transfer off timings) differ from one another due to the conditions determined by equations (1) to (9). Accordingly, the transfer bias is not turned off at the same position in a recording medium.

Determination of off timings in the image formation units is described below by using, as reference timing, the bias off timing of the transfer bias applying unit (the transfer bias power source 44, the switching unit 48, and the bias control portion 71) of the image forming unit 11Y (the first image formation unit) including photosensitive drum 31 located at the uppermost stream position.

That is, as illustrated in FIGS. 2 and 4, N photosensitive drums each serving as an image bearing member (N is greater than or equal to 3), that is, the four photosensitive drums 31 to 34 are disposed. In addition, N image formation units (N is greater than or equal to 3), that is, the four image forming units 11Y to 11Bk are disposed. Furthermore, N primary transfer rollers each serving as a transfer member (N is greater than or equal to 3), that is, the four primary transfer rollers 39 to 42 are disposed. Still furthermore, N transfer bias applying units (the transfer bias power source 44, the switching units 48 to 51, the bias control portion 71) (N is greater than or equal to 3), that is, the four transfer bias applying units corresponding to the switching units 48 to 51 are disposed. In this manner, the image forming unit 11Y (the first image formation unit) to the image forming unit 11Bk (the n-th image formation unit) are sequentially arranged from the upstream to the downstream along the movement direction of the intermediate transfer belt 13 (the intermediate transfer member) (the direction of the arrow H).

First Setting

In the above-described configuration, let L be the distance between the contact points of adjacent ones of the photosensitive drums 31 to 34 with the intermediate transfer belt 13 along the intermediate transfer belt 13 (along the intermediate transfer member), and let V be the moving speed of the intermediate transfer belt 13. Then, the control unit 45 serving as a setting unit sets the following setting.

That is, for every integer n that is greater than or equal to 2 and less than or equal to N, a timing at which the transfer bias applying unit (the transfer bias power source 44, the switching unit 48, and the bias control portion 71) in the image forming unit 11Y (the first image formation unit) is turned off is used as a reference. By using such a reference, a timing at which the transfer bias applying unit (the transfer bias power source 44, the switching unit 51, and the bias control portion 71) in the image forming unit 11Bk (the n-th image formation unit) is turned off is defined as $(L/V)\times(n-1)+\alpha_n$. At that time, the control unit 45 sets $\alpha_n$ so that the absolute value of $\alpha_n$ is less than L/V and, in addition, at least one pair of $\alpha_n$ among a plurality of $\alpha_n$ has different values. Note that $\alpha_n$ represents a deviation of a transfer off timing.

If the impact of offset can be ignored, the setting can be set without taking into account the offset distance X of each of the primary transfer rollers 39 to 42, as described above. In such a case, some effect can be obtained even when all $\alpha$ are not different values. Thus, it is only required that at least one pair of $\alpha$ among a plurality of $\alpha$ has different values.

Second Setting

For every integer n that is greater than or equal to 2 and less than or equal to N, a timing at which the transfer bias applying unit (the transfer bias power source 44, the switching unit 48, and the bias control portion 71) in the image forming unit 11Y (the first image formation unit) is turned off is used as a reference. By using such a reference, a timing at which the transfer bias applying unit (the transfer bias power source 44, the switching unit 51, and the bias control portion 71) in the image forming unit 11Bk (the n-th image formation unit) is defined as $(L/V)\times(n-1)+\alpha_n$. At that time, the control unit 45 sets $\alpha_n$ so that the absolute value of $\alpha n$ is less than L/V and, in addition, the plurality of $\alpha_n$ are different values. If the impact of offset can be ignored, the setting can be set without taking into account the offset distance X of each of the primary transfer rollers 39 to 42, as described above. In such a case, the plurality of $\alpha$ are set to different values.

Third Setting

In addition, if the offset distance X described below is considered as a factor, the setting can be set as follows. That is, the offset distance X is a distance between a contact point between the intermediate transfer belt 13 and each of the photosensitive drums 31, 32, 33, and 34 (the point A illustrated in FIG. 4) and a contact point between the intermediate transfer belt 13 and the corresponding one of the primary transfer rollers 39, 40, 41, and 42 corresponding to the photosensitive drum (a point B illustrated in FIG. 4) along the movement direction of the intermediate transfer belt 13 (the direction of the arrow H illustrated in FIG. 2).

That is, for every integer n that is greater than or equal to 2 and less than or equal to N, a timing at which the transfer bias applying unit (the transfer bias power source 44, the switching unit 48, and the bias control portion 71) in the image forming unit 11Y (the first image formation unit) is turned off is used as a reference. By using such a reference, a timing at which the transfer bias applying unit (the transfer bias power source 44, the switching unit 51, and the bias control portion 71) in the image forming unit 11Bk (the n-th image formation unit) is defined as $(L/V)\times(n-1)+\alpha_n$. At that time, the control unit 45 sets $\alpha n$ so that the absolute value of $\alpha_n$ is greater than X/V and less than L/V and, in addition, at least one pair of $\alpha_n$ among the plurality of $\alpha_n$ has different values.

Fourth Setting

In addition, if the offset distance X described above is considered as a factor, the setting can be set as follows. That is, for every integer n that is greater than or equal to 2 and less than or equal to N, a timing at which the transfer bias applying unit (the transfer bias power source 44, the switching unit 48, and the bias control portion 71) in the image forming unit 11Y (the first image formation unit) is turned off is used as a reference. By using such a reference, a timing at which the transfer bias applying unit (the transfer bias power source 44, the switching unit 51, and the bias control portion 71) in the image forming unit 11Bk (the n-th image formation unit) is defined as $(L/V)\times(n-1)+\alpha_n$. At that time, the control unit 45 sets $\alpha_n$ so that the absolute value of $\alpha_n$ is greater than X/V and less than L/V and, in addition, the plurality of $\alpha_n$ are different values.

Figure 7A:
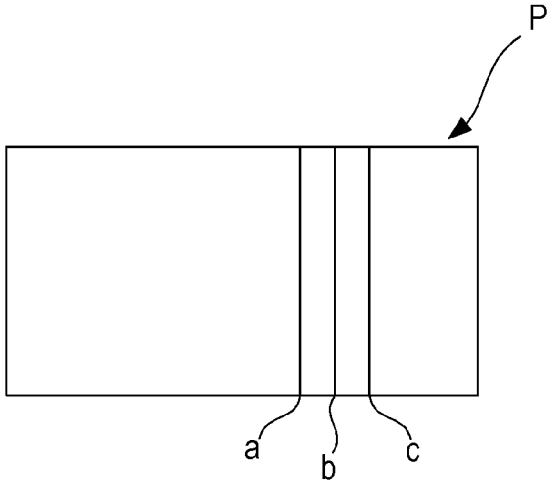
FIG. 7A illustrates a line-like image according to the exemplary embodiment.
Figure 7B:
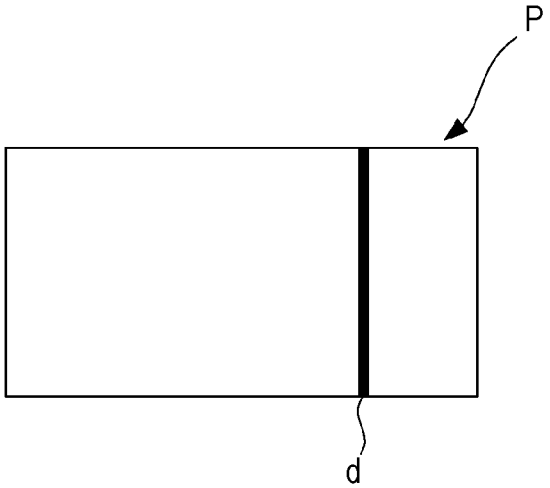
FIG. 7B illustrates a line-like image according to the comparative example.

At that time, the variation in speed of the intermediate transfer belt 13 occurs due to a variation of the level of an electrostatically attractive force between the intermediate transfer belt 13 and each of the photosensitive drums 31 to 34 generated when transition from a transfer-on state to a transfer-off state occurs for each of the colors. According to the present exemplary embodiment, the control unit 45 performs control on the basis of the first to fourth settings described above. Accordingly, the variation of speed of the intermediate transfer belt 13 occurs at different positions in the recording medium (positions a, b, and c illustrated in FIGS. 7A and 7B). Accordingly, a line-like image caused by a variation of the position can be made faint and is reduced.

Control performed when a full-color image is formed according to the present exemplary embodiment is described with reference to the schematic illustration in FIG. 4 and the timing diagram illustrated in FIG. 5.

That is, in the image forming apparatus 1, the laser beam 53 generated in accordance with image data is emitted from the exposure unit 22 under the control of the image forming portion 70. By emitting the laser beam 53 onto the surface of each of the photosensitive drums 31 to 34, an electrostatic latent image is formed on the photosensitive drum charged by one of the charging devices (not illustrated).

Thereafter, toner supplied from the developing unit (not illustrated) is deposited onto the electrostatic latent image and is visualized as a toner image. The toner images are sequentially primary-transferred onto the intermediate transfer belt 13 that is moving in synchronization with the rotation of the photosensitive drum through the transfer operations performed by the primary transfer rollers 39 to 42.

During the primary transfer, the primary transfer drive control portion 72 controls the color motor 64 and the Bk motor 61 via the drive circuit 46 to drive the primary transfer rollers 39 to 42. Furthermore, the bias control portion 71 performs on/off control on the transfer bias power source 44 to apply the transfer bias voltage to the primary transfer rollers 39 to 42 using the switching units 48 to 51, respectively, as follows.

That is, a first primary transfer bias is applied to the primary transfer roller 39 for a Y color to turn on the primary transfer roller 39 first. Thereafter, the first primary transfer bias is sequentially applied to the primary transfer roller 40 for an M color, the primary transfer roller 41 for a C color, and the primary transfer roller 42 for a Bk color to turn on the primary transfer rollers. That is, while the primary transfer roller 39 is rotating under the control of the control unit 45, the transfer bias for a Y color is turned on (t1), and a primary transfer operation for a Y color is started (turned on) (t2). In addition, while the primary transfer roller 40 is rotating, the transfer bias for an M color is turned on (t3), and a primary transfer operation for an M color is started (turned on) (t4). Furthermore, while the primary transfer roller 41 is rotating, the transfer bias for a C color is turned on (t5), and a primary transfer operation for a C color is started (turned on) (t6). Still furthermore, while the primary transfer roller 42 is rotating, the transfer bias for a Bk color is turned on (t7), and a primary transfer operation for a Bk color is started (turned on) (t8).

In addition, the primary transfer operation performed by the primary transfer roller 39 for a Y color that is on is turned off (t9), and the transfer bias for a Y color is turned off (t10). Furthermore, the primary transfer operation performed by the primary transfer roller 40 for an M color that is on is turned off (t11), and the transfer bias for an M color is turned off (t12). Still furthermore, the primary transfer operation performed by the primary transfer roller 41 for a C color that is on is turned off (t13), and the transfer bias for a C color is turned off (t14). Still furthermore, the primary transfer operation performed by the primary transfer roller 42 for a Bk color that is on is turned off (t15), and the transfer bias for a Bk color is turned off (t16).

Subsequently, the different toner images formed on the photosensitive drums are transferred onto the intermediate transfer belt 13 one on top of the other to form a four-color toner image on the intermediate transfer belt 13. Thereafter, the color toner image on the intermediate transfer belt 13 is secondary-transferred onto the recording medium P, which has been fed from the paper cassette 4, in the secondary transfer unit (N2) located between the secondary transfer outer roller 16*b* and the intermediate transfer belt 13. Finally, the recording medium P having the color toner image transferred thereonto is subjected to a fixing process in the fixing unit 17 and, thereafter, is output onto the sheet discharge tray 21.

A comparative example in which the conditions according to the present exemplary embodiment are not set is described with reference to FIG. 6.

Figure 6:
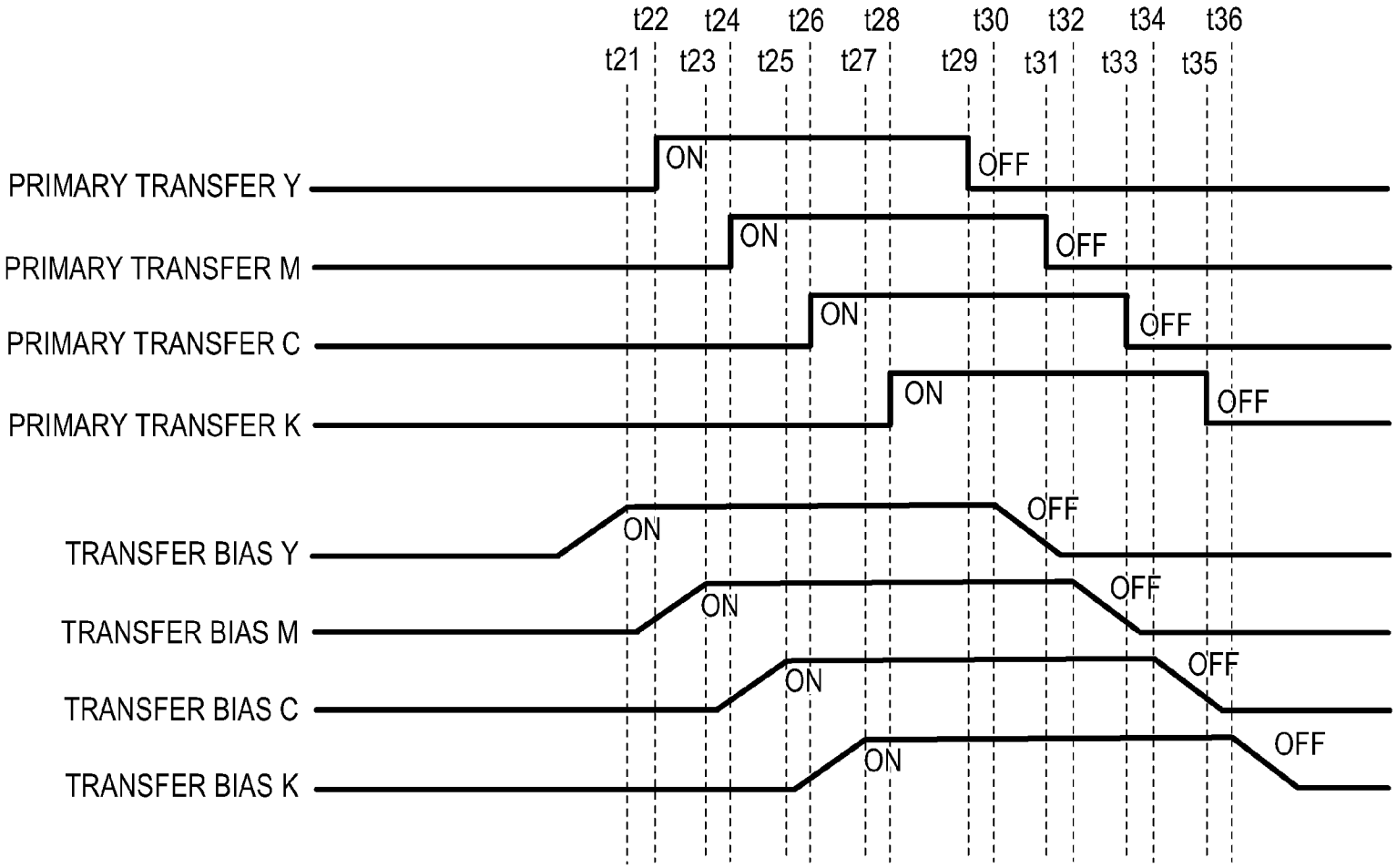
FIG. 6 is a timing diagram illustrating an example of operation control according to a comparative example.

That is, as illustrated in FIG. 6, in the comparative example, the transfer bias for a Y color is turned on (t21), and the primary transfer operation for a Y color is started (turned on) (t22). In addition, the transfer bias for an M color is turned on (t23), and the primary transfer operation for an M color is started (turned on) (t24). Furthermore, the transfer bias for a C color is turned on (t25), and the primary transfer operation for a C color is started (turned on) (t26). Still furthermore, the transfer bias for a Bk color is turned on (t27), and the primary transfer operation for a Bk color is started (turned on) (t28).

In addition, the primary transfer operation performed by the primary transfer roller for a Y color that is on is turned off (t29), and the transfer bias for a Y color is turned off (t30). Furthermore, the primary transfer operation performed by the primary transfer roller for an M color that is on is turned off (t31), and the transfer bias for an M color is turned off (t32). Still furthermore, the primary transfer operation performed by the primary transfer roller for a C color that is on is turned off (t33), and the transfer bias for a C color is turned off (t34). Still furthermore, the primary transfer operation performed by the primary transfer roller for a Bk color that is on is turned off (t35), and the transfer bias for a Bk color is turned off (t36).

Unlike the above-described exemplary embodiment, according to the above-described comparative example, the conditions are not set. Accordingly, a variation of the position occur at the same position in one recording medium. Thus, the line-like image extending in the main scanning direction becomes darker, as indicated by "d" in FIG. 7B.

In contrast, according to the present exemplary embodiment, the occurrence of a situation in which a primary transfer time is unnecessarily too long can be prevented and, in addition, the life times of the primary transfer rollers 39 to 42, the intermediate transfer belt 13, and the photosensitive drums 31 to 34 can be maintained unchanged. Furthermore, a variation of the speed of the intermediate transfer belt 13 caused by transfer bias on/off switching can be prevented and, thus, degradation of the image quality, such as out of color registration, can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-057969 filed Mar. 20, 2014, which is hereby incorporated by reference herein in its entirety.

What is claimed is:

1. An image forming apparatus comprising:

N image bearing members each allowing a toner image to be formed thereon, where N is 3 or greater;

N image forming units each having one of the image bearing members, the image bearing members being disposed at equal intervals;

an intermediate transfer member configured to move so as to allow toner images to be sequentially transferred thereonto at transfer positions at which the intermediate transfer member faces the image bearing members, the first to N-th image forming units being sequentially arranged from the upstream to the downstream along a movement direction of the intermediate transfer member;

N transfer members each configured to transfer a toner image from one of the image bearing members onto the intermediate transfer member at a transfer position located between the intermediate transfer member and the image bearing member;

N transfer power sources each configured to apply a transfer bias to one of the N transfer members; and a setting unit configured to set, when L is defined as a distance between contact points of every two adjacent ones of the first to N-th image bearing members with the intermediate transfer member, when V is defined as a moving speed of the intermediate transfer belt, and when a timing at which the transfer power source for the n-th image forming unit is turned off using a timing at which the transfer power source for the first image forming unit is turned off as a reference is defined as $$(L/V)\times(n-1)+\alpha_n,$$

$\alpha_n$ for every integer n greater than or equal to 2 and less than or equal to N so that an absolute value of $\alpha_n$ is less than L/V and at least one pair of $\alpha_n$ among the plurality of $\alpha_n$ has different values.

2. The image forming apparatus according to claim 1, wherein the setting unit sets $\alpha_n$ so that the plurality of $\alpha_n$ have different values.

3. The image forming apparatus according to claim 1, wherein when X is further defined as a distance between a contact point between the image bearing member and the intermediate transfer member and a contact point between the transfer member corresponding to the image bearing member and the intermediate transfer member along the movement direction of the intermediate transfer member, the setting unit sets $\alpha_n$ so that an absolute value of $\alpha_n$ is greater than X/V.

4. The image forming apparatus according to claim 3, wherein the setting unit sets $\alpha_n$ so that the plurality of $\alpha_n$ have different values.

5. The image forming apparatus according to claim 1, wherein the intermediate transfer member is a continuous intermediate transfer belt that is movably kept under tension, and the transfer member is a transfer roller that is rotatable while in contact with the intermediate transfer belt.

6. The image forming apparatus according to claim 2, wherein the intermediate transfer member is a continuous intermediate transfer belt that is movably kept under tension, and the transfer member is a transfer roller that is rotatable while in contact with the intermediate transfer belt.

7. The image forming apparatus according to claim 3, wherein the intermediate transfer member is a continuous intermediate transfer belt that is movably kept under tension, and the transfer member is a transfer roller that is rotatable while in contact with the intermediate transfer belt.

8. The image forming apparatus according to claim 4, wherein the intermediate transfer member is a continuous intermediate transfer belt that is movably kept under tension, and the transfer member is a transfer roller that is rotatable while in contact with the intermediate transfer belt.

* * * * *